United States Patent [19]

Veverka et al.

[11] Patent Number: 4,553,008

[45] Date of Patent: Nov. 12, 1985

[54] LOAD INTERRUPTER

[75] Inventors: Edward F. Veverka, Franksville; Nils V. Holmgren, Greendale; Donald R. Martin, Racine, all of Wis.

[73] Assignee: Cooper Industries, Inc., Houston, Tex.

[21] Appl. No.: 620,515

[22] Filed: Jun. 14, 1984

[51] Int. Cl.[4] ..... H01H 33/82

[52] U.S. Cl. ..... 200/148 R; 200/148 A; 200/148 B

[58] Field of Search ..... 200/148 A, 148 R, 148 B

[56] References Cited

U.S. PATENT DOCUMENTS

| | | | |
|---|---|---|---|
| 3,996,439 | 12/1976 | Takuyama et al. | 200/148 A |
| 4,211,904 | 7/1980 | Karrenbauer | 200/148 A |
| 4,286,128 | 8/1981 | Ruffieux et al. | 200/148 B |
| 4,465,910 | 8/1984 | Martin | 200/148 A |
| 4,467,158 | 8/1984 | Kobayushi et al. | 200/148 A |

*Primary Examiner*—Robert S. Macon
*Attorney, Agent, or Firm*—E. E. Scott

[57] ABSTRACT

An load interrupter is disclosed having the characteristics of an ordinary puffer interrupter and a self-extinguishing gas flow interrupter. The load interrupter comprises a generally hollow cylinder which is adapted to be filled with an arc extinguishing fluid and which has an electrically insulated nozzle at one end. A piston is sealingly and slidingly disposed within the cylinder so as to be movable between a first and second position to change the internal volume of the cylinder that is in flow communication with the nozzled end. A stop limits the relative motion between the piston and the nozzled end of the cylinder. A spring biases the piston against the stop. One of the two contacts across which the arc is formed is carried by the piston. The other contact is operated by a prime mover to move into and out of the chamber formed by the piston, cylinder and nozzle. Thus, under low current conditions, the piston follows the movement of the other contact. Under high current carrying or fault conditions, the spring designed to be overcome by the energy released from the arc so as to control the temperature and pressure rise adequately enough to extinguish the arc by the self-extinguishing principle. The moving contact has a tip formed from an electrical insulating material to constrict the arc at the throat of the nozzle thereby increasing the arc extinguishing efficiency of the interrupter.

14 Claims, 7 Drawing Figures

FIG. 3
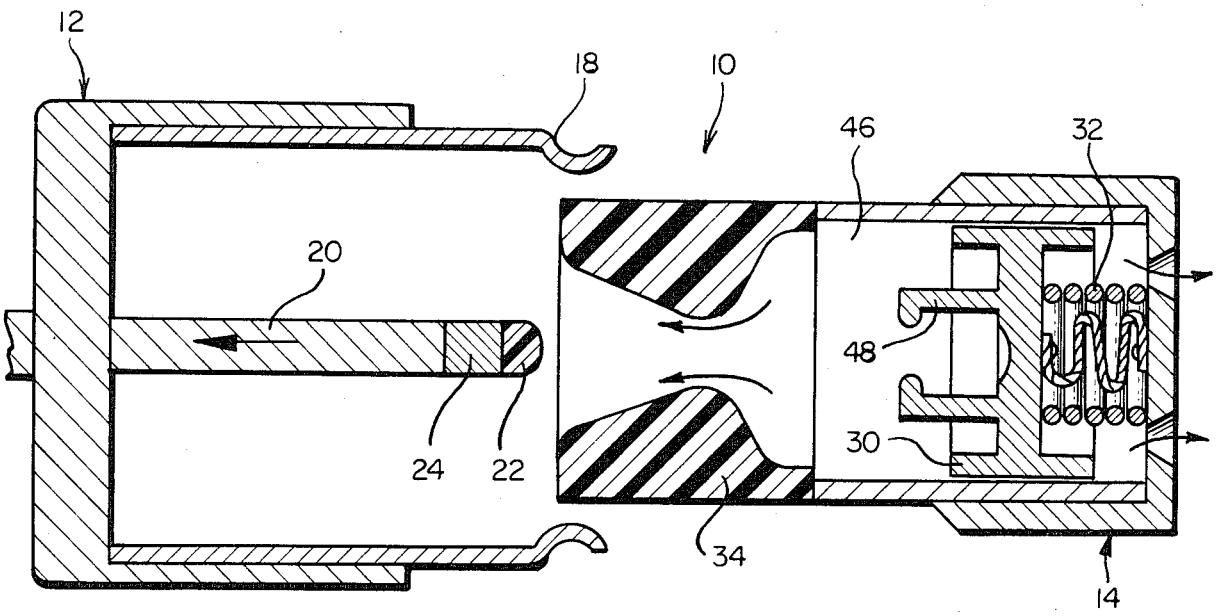
FIG. 5
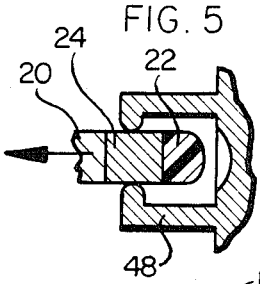
FIG. 6
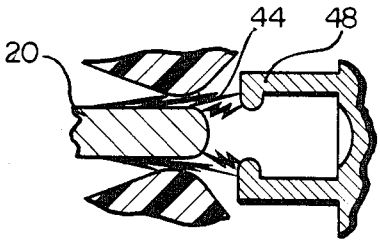
FIG. 7
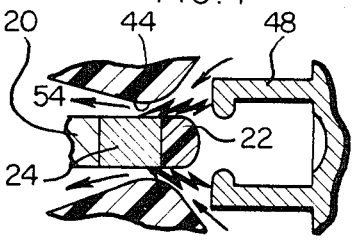
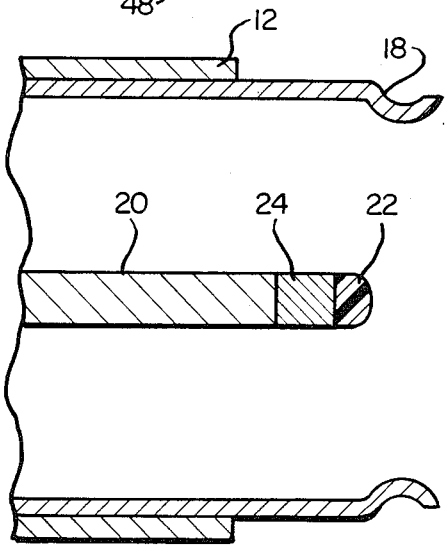
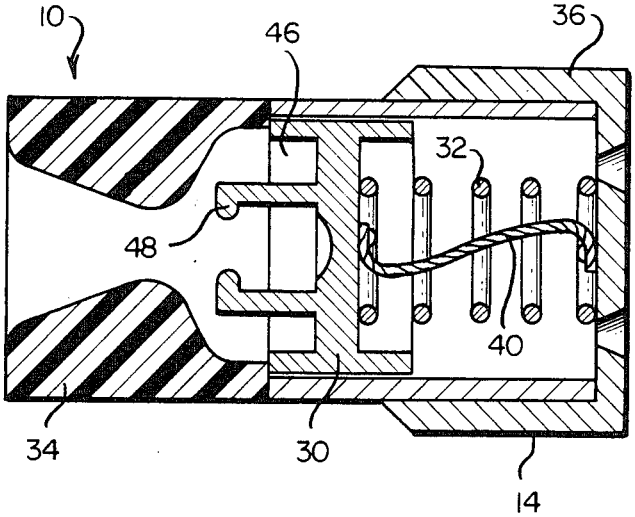
FIG. 4

LOAD INTERRUPTER

TECHNICAL FIELD

This invention relates, in general, to circuit interrupters and, more particularly, to small fluid-blast circuit interrupters of the puffer type designed to interrupt loads of approximately 2000 amps at 15,000 volts.

BACKGROUND OF THE INVENTION

A relatively recent advance in design of circuit interrupters has been the so called "self-extinguishing" puffer interrupter. Here the pressure raising function of the electrical arc, due to the thermal energy released by the arc, is used to provide a source of high-pressure gas which is released through the arcing region to extinguish the arc. Those skilled in the art know that high-temperature arc extinguishing gas has a lower density which promotes ionization and has a relatively low insulating capability. In other words, higher temperature fluid has a higher conductivity and a lower capacity for extinguishing an arc. Thus, in a "self-extinguishing" puffer interrupter, large-capacity current interruption is difficult to obtain if the volume of fluid is kept constant. This limitation tends to off-set the benefits gained by being able to use a prime mover which is smaller in size than that used in an ordinary puffer interrupter. Several patents have been granted for inventions the purpose of which is to improve the arc extinguishing capability during high current carrying conditions: U.S. Pat. No. 4,221,943; U.S. Pat. No. 4,225,762; U.S. Pat. No. 4,239,949; U.S. Pat. No. 4,242,550; U.S. Pat. No. 4,243,860; U.S. Pat. No. 4,253,002; and EPC No. 00 19 806 (or U.S. Pat. No. 4,445,020). However, this effort has been largely concerned with fault interrupters (i.e., 2000 amp. load current could have a fault current of 20,000 amps). Load interrupters (i.e., 2000 amp load rating with interruption required under any load between 0 and 2000 amps) represent a separate and distinct problem to those skilled in the art.

From the foregoing it should be clear that high-pressure is relatively easy to obtain in a self-extinguishing puffer interrupter when the arc current is large (i.e., fault current) and that, as the arc current decreases, the pressure necessary to cause interruption becomes more difficult to achieve. In other words, when the current is relatively small (i.e. low laod), the pressure produced within the chamber surrounding the arc is generally insufficient to produce interruption (i.e., the volume is fixed and the thermal energy released is small). Several inventions have been patented whose purpose is to provide adequate arc extinguishing capability in the low current range: U.S. Pat. No. 4,259,555; U.S. Pat. No. 4,270,034; and U.S. Pat. No. 4,327,263. Examination of these patents and those previously cited will show that a satisfactory solution to the problem of providing a self-generating or self-extinguishing gas flow load interrupter which performs satisfactory under both full load current and low load current ranges has not yet been achieved. An inexpensive, relatively simple design for a load interrupter, which performs satisfactorily in both the high and the low current ranges, will be a welcome addition to the art.

SUMMARY OF THE INVENTION

In accordance with the present invention, an interrupter is disclosed which has a variable volume arc extinguishing or arcing chamber whose size is satisfactory in relationship to the arc thereformed to enable the interrupter to function efficiently under both low load current and full load current flow conditions. Thus, both large and small currents can be efficiently accommodated without requiring an unnecessarily large prime mover or arcing chamber. Specifically, in one embodiment an interrupter is provided that comprises: a generally hollow, cylindrical housing which is adapted to be filled with an arc extinguishing gas; a piston which is movably and sealingly disposed at one end along the interior of the housing; an electrically insulated flow control nozzle at the other end of the housing; a spring or biasing means for biasing the piston against a stop element located at the flow control nozzle end of the housing; and a composite arcing probe whose function is to produce an electrical arc in the arcing or variable volume chamber defined by the housing, the piston and the flow control nozzle. In one embodiment the arc is produced by separating one contact which is carried by the piston and an elongated arcing probe which is moved by a prime mover into and out of the housing through the throat of the flow control nozzle. An especially unique feature of the arcing probe, which passes through the throat of the flow nozzle, is that it has a tip formed from an electrical insulating material. This design causes the arc, which is formed during circuit interruption, to be drawn between the contact carried by the piston to that part of the arcing probe at the throat of the nozzle. In particular, one end of the arc is constricted between the exterior of the electrically insulated portion of the arcing probe and the interior of the insulated throat. The electrically insulated probe and nozzle will ablate to produce arc extinguishing gases which are very beneficial to interruption especially at the lower end of the current range. The flow of gas out of the variable volume chamber is allowed to flow through the nozzle throat as the arcing probe is withdrawn to be fully utilized to extinguish the arc. The biasing means tends to maintain the piston against the insulated tip of the arcing probe until the piston stop is encountered causing a pressure rise in the variable volume chamber; therefore in the absence of a high load current arc, the volume of the chamber varies, for the most part, in direct response to the movement of the arcing probe. Effectively, the device performs as a highly efficient puffer interrupter when low currents are interrupted. A biasing means is selected having a "spring constant" such that the biasing means is overcome by the energy released by the arc when a high load current is interrupted. In the high load current case, the volume of the chamber between the piston and the flow-control nozzle increases. This prevents the gas from reaching excessive levels of temperature and pressure. Moreover, in contrast to the operation when low load currents are interrupted, the energy stored in the spring or biasing means provides an additional blast of gas to keep the arc from reforming as the arcing probe is withdrawn from the arcing chamber and nozzle throat. Effectively, the device performs as a self-extinguishing interrupter at the beginning of the arc extinguishing cycle and as a conventional puffer interrupter at the end of the interruption cycle when high load currents are interrupted.

It will become readily apparent from the following detailed description of the invention and the embodiments described therein that the motion of the piston is essentially dependent on the arc energy released during current interruption. Moreover, since the piston is free to move within the housing, the biasing means reduces the mechanical load requirements of the prime mover when a high load currents are interrupted. Similarly, the insulated tip on the arcing probe in conjunction with the insulating nozzle maximizes the efficiency of the device during low load current interruption. Other advantages and features of the present invention will become apparent from the following description, from the claims and from the accompanying drawings.

BRIEF DESCRIPTIONS OF THE DRAWINGS

FIG. 3 is a partial, cross-sectional elevational, view of the interrupter shown in FIG. 1 after the interrupter has been opened under a high current flow condition;

FIG. 4 illustrates the position of the components shown in FIG. 1 after the interrupter has been fully opened;

FIG. 5 is a partial, cross-sectional view of the position of the contacts shortly after the interrupter is placed in operation;

FIG. 6 is a representation of the arc which would be formed, if an ordinary arcing probe were used; and FIG. 7 is a partial cross-sectional, elevational view of the position of the contacts after they have physically separated illustrating the manner in which the arc drawn into the throat of the flow control nozzle.

DETAIL DESCRIPTION OF THE PREFERRED EMBODIMENT

Figure 1:
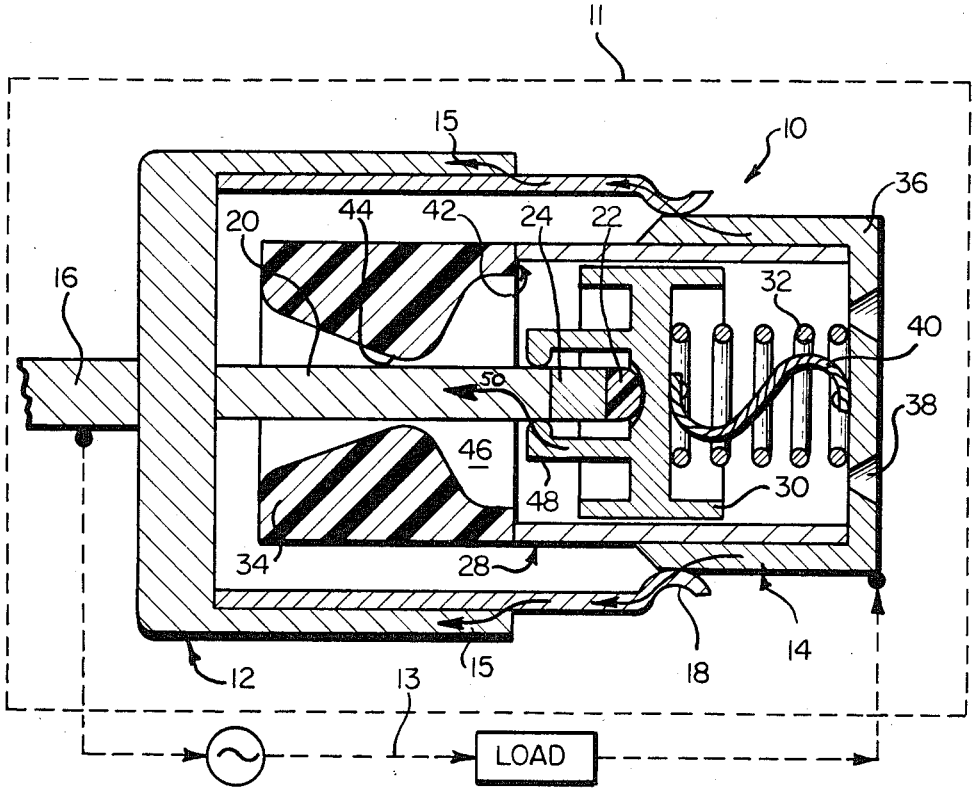
FIG. 1 is a cross-sectional, elevational view of the interrupter that forms the subject of the invention with the interrupter in its closed position.

While this invention is succeptable of embodiment in many different forms, there is shown in the drawings and will herein be described in detail one specific embodiment with the understanding that the present disclosure is to be considered as an exemplification of the principles of the invention and not intended to limit the invention to the specific embodiment illustrated.

For ease of description, the load interrupter that is the subject of this invention will be described in one particular orientation, specifically in the orientation illustrated in the drawings, and the terms "right", "left", etc., will be used with reference to this position. It will be understood however, that the apparatus of the invention may be manufactured, stored, transported, and sold in other orientation than that illustrated.

COMPONENTS

Figure 2:
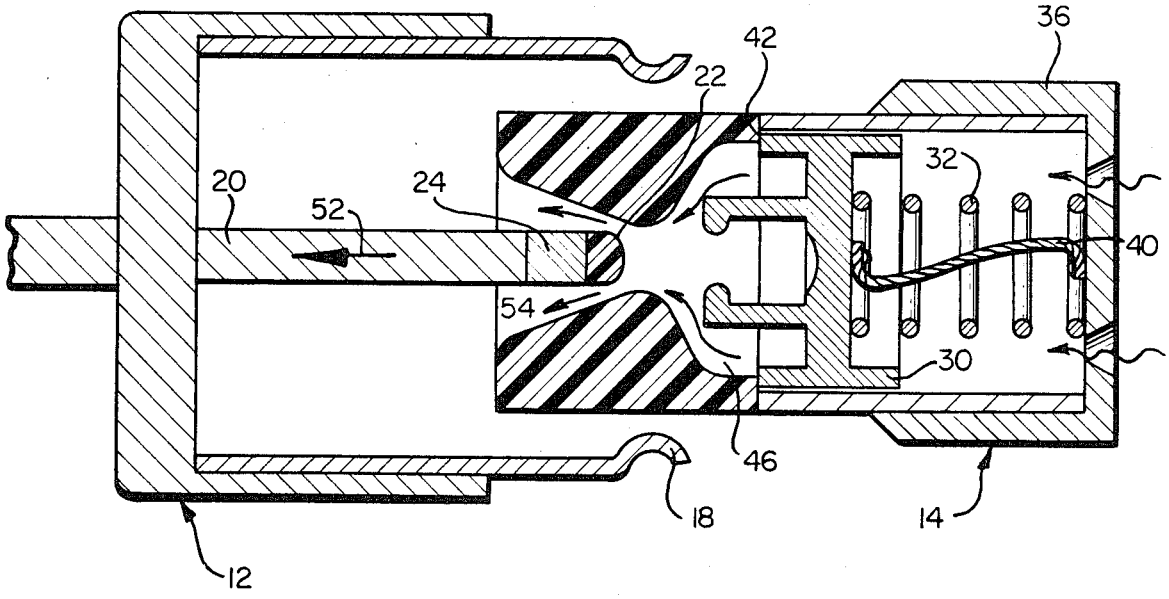
FIG. 2 is a partial, cross-sectional, elevational view of the interrupter shown in FIG. 1 after the interrupter has been opened under a low or no electrical current flow condition.

For the purpose of general orientation, the principal components of the invention will be identified with reference to FIG. 1. After all the major components have been described, the operation device will be explained with particular reference to FIGS. 2, 3 and 4. As is the usual case, the load interrupter 10 is housed within a tank or enclosure 11 which is filled with an arc extinguishing gas such as sulfur-hexafloride ($SF_6$). The load interrupter 10 is formed from two electrical current carrying members or assemblies 12 and 14 which are coaxially disposed relative to each other and which are interposed across an external electrical circuit 13 (schematically illustrated in phantom) by conventional current interchanges (not illustrated in detail for purposes of simplicity). One current carrying member 14 (i.e., the right-hand member using the orientation of the drawings) is essentially fixed in position while the other current carrying member 12, the left-hand one, is mounted so as to be movable by a prime mover towards and away from the fixed current carrying member 14.

The left-hand current carrying member 12 is moved by a prime mover of the type typically used for such applications and well known to those skilled in the art. One or more connecting rods 16 are used to join the left-hand current carrying member 12 to the prime mover. When the left-hand current carrying member 12 is moved to its extreme right-hand position the two current carrying members 12 and 14 come into contact with each other in an overlapping relationship such that a good electrical current flow path (i.e., See arrow 15) is formed and the interrupter 10 is said to be in its "closed" or "shut" position. When the two current carrying members 12 and 14 are fully separated (See FIG. 4), the interrupter 10 is said to be in its "open" or "tripped" position.

Turning first to the movable current carrying member 12, it comprises a plurality of radially disposed main contact fingers 18 and a central arcing probe 20. These fingers 18 are fixed at one end and disposed inwardly at the other end (i.e., their right-hand end) so as to make sliding contact with the fixed current carrying member 14. A set of encircling garter springs may be used to bias the free ends of the fingers 18 towards the fixed current carrying member 14. The arcing probe 20 is disposed at the center of the contact fingers 18 and is generally rod-like in shape. An especially unique feature of the movable arcing probe 20 is the manner in which the tip or free end 22 of the probe is formed. This is most clearly shown in FIG. 3. The free end or tip 22 is formed from electrical insulating material, such as a silica loaded polytetrafluro-ethylene (i.e., TEFLON) or an acetal (i.e., DELRIN) that is resistant to arc erosion. Immediately adjacent to the insulated tip 22 is a section or portion 24 formed from an electrically conductive arc resisting material, such as copper tungsten. The relationship between the insulated tip 22 and the electrically conductive material section 24 to the remainder of the arcing probe 20 will become apparent once the fixed current carrying member 14 is explained.

Turning now to the fixed current carrying member 14, this member is formed from an open ended hollow cylinder or casing 28, a piston 30, a biasing spring 32, a flow control nozzle 34 at one end of the cylinder and a cylinder cap or head 36 at the other end of the cylinder. The piston 30 is slidably and sealingly disposed or housed within the interior of the hollow cylindrical casing 28. The flow control LAVAL nozzle 34 plugs that end of the housing 28 which is adjacent to the movable arcing probe 20. The cylinder cap 36 is provided with a plurality of vent holes or openings 38. The openings 38 in the cylinder cap 36 allow gas in the space between the piston 30 and the cylinder cap to be released or vented when the piston moved towards the cylinder cap. The biasing spring 32 is disposed between the cylinder cap 36 and the piston 30. Here a single coil spring 32 is used. It should be clear that other spring-like devices and methods may be used to locate the piston 30 relative to one end of the cylinder 28. A flexible electrical lead 40 connects the cylinder cap 36 with the piston 30. Other current conducting means may be used to join the cap 36 with the piston 30 (i.e., MULTI-LAM contact band between the piston and the cylinder). The flow control nozzle 34 is provided with a shoulder 42 to limit motion of the piston 30. As such the shoulder 42 acts a "stop". The flow control nozzle 34 is perferrably formed from a silica loaded TEFLON insulating material. The nozzle 34 defines a nozzle throat 44 which is adapted to receive the movable arcing probe 20. As such, the interior of the cylinder 28 defines a chamber 46 whose volume is dependent upon the position of the piston 30 and the movable arcing probe 20. As such, this chamber may be considered a "variable volume chamber". Note: TEFLON and DELRIN are registered trademarks of DuPont (E.I. DeNemours & Co.) and MULTILAM is a registered trademark of Hugin Industries, Inc.

Electrical contact between the piston 30 and the movable arcing probe 20 is provided by a set of arcing contacts 48 which are radially disposed about the arcing probe 20 when the interrupter 10 is closed. In this manner electrical current is free to flow from the external circuit 13 through the cylinder cap 36, across the electrical lead 40, the piston 30 and the arcing contacts 48 in passing electrical current to the movable current carrying member 12. It should be noted that when the interrupter 10 is closed, the length of the arcing probe 20 is sufficiently long so that when the tip 22 of the arcing probe 20 engages the piston 30, the biasing force of the spring 32 is overcome and the piston is moved (in the right direction according to the orientation of the drawings) from the stop 42 on the flow control nozzle 34. It should also be noted that the size of the throat 44 of the flow control nozzle 34 is such that when the interrupter 10 is closed the distance between the interior edges of the throat and the exterior of the arcing probe 20 defines a annular narrow opening or channel. Typical dimensions in the case of a small load interrupter would be a 1/32 inch clearance for a throat diameter of $\frac{3}{8}$ to $\frac{1}{2}$ inches. The importance of this arrangement will become apparent once the operation of the interrupter 10 is described in greater detail.

Turning our attention now to the exterior of the cylinder 28, it will be observed that the contact fingers 18 are spaced relative to the position of the piston 30 and the tip 22 of the arcing probe 20, when interrupter 10 is closed, such that the contact fingers separate from the cylinder cap 36 before the arcing contacts 48 and the arcing probe separate. Thus, immediately after the interrupter 10 is moved to its open position, the flow of electrical current is shifted from the path (See arrow 15) and through the contact fingers 18 to a path (See arrow 50) at the interior of the other cylinder 28. It is at the interior of the cylinder 28 where the arc is formed. As such the interior chamber 46 may be considered to be a "arcing chamber". This insures that a sharp clean arc is formed at the interior of the interrupter 10 when it is opened.

OPERATION

Now that the principle components of the load interrupter 10 have been identified and explained, the integrated operation of the interrupter will be described. To interrupt the current flowing across the interrupter (See arrow 15 in FIG. 1), the prime mover is operated to stroke or drive the left-hand current carrying member 12 away from the fixed current carrying member 14 (See arrow 52 in FIG. 2). For purposes of generality, let us first assume that little or no current is flowing through the interrupter 10. When the main current carrying contact fingers 18 separate from the cylinder cap 36, all of the current flow is diverted to the center arcing probe 20 and the fixed arcing contacts 48 (See arrow 50). Now when the electrically conducting portion or section of arcing probe 20 separates from the fixed arcing contacts 48, the main electrical arc is formed. Some of the details of arc formation will be explained in a subsequent paragraph. The electrical arc heats and dis-associates the arc extinguishing gas within the interior of the arcing chamber 46 so as to produce the source of high pressure gas. The high pressure forces gas through the nozzle throat 44 (See arrow 54) and against the piston 30. It should be clear that a biasing means or spring 32 can be provided with a sufficiently high "spring constant" so as to maintain the floating piston 30 essentially fixed relative to the moving contact tip 22 until the stop 42 is reached.

However, because of the unique composition of the arcing probe 20, the left-hand end of the arc is drawn into the nozzle throat as the arcing probe 20 is withdrawn from the arcing chamber 46. At first, the arcing contacts 48 stay fixed in position relative to the arcing probe 20. Both move together to the left. However, when the piston 30 comes into contact with the stop 42, the arcing contacts 48 slide towards the non-conducting tip 22 of the arcing probe 20 (See FIG. 5). Eventually, the arcing contacts 48 will separate from the electrically conducting portion 24 of the arcing probe 20. It is at this point that the arc is drawn. If the tip of the arcing probe 20 were conducting (See FIG. 6), the arc would be drawn between the tip of the arcing 20 and the tips of the arcing contacts 48. However, the tip 22 of the arcing probe 20 is preferably made from an electrical insulating material. Accordingly, the left-hand end of the arc will be confined to the periphery of the arcing probe 20, and in particular, around the eletrically conducting section 24. Thus, as the arcing probe 20 is driven further to the left, the left-hand end of the arc is drawn into the nozzle throat 44 (see FIG. 7). Since the annular space between the periphery or exterior of the arcing probe 20 and the edge of the throat 44 of the LAVAL nozzle 34 is relatively narrow and confining, the high pressure gases (both from the volume 46 and those formed due to ablation of the nozzle 34 and insulating tip 22) flowing through the nozzle are applied to the arc with the greatest efficiency. This should be clear from a study of FIG. 7. As long as the arc is disposed or positioned at the tip 22 of the arcing probe 20, the gases flowing through the throat 44 of the nozzle will be wasted (i.e., FIG. 6.) This is an especially unique feature of the invention. It maximizes the efficiency of the arc interruption process. Once the arc is extinguished, the components of the interrupter 10 will assume the configuration shown in FIG. 4.

Now turning our attention to FIG. 3, the operation of the interrupter 10 will be described when it operates under high current carrying or fault conditions. In this case, the energy released by the arc is substantially larger than that released when little or no current is flowing across the interrupter. Here sufficient pressure is generated within the arc extinguishing chamber 46' so as to overcome the biasing means 32 and the frictional and mechanical forces associated with the piston 30 so as to drive or move the piston to the right or away from the direction of the movement of the moving contact 12. Thus, relative to the situation described with respect to FIG. 2, adequate expansion space is provided for the gas in the arc extinguishing chamber 46' so as to provide for arc extinction without an excessive pressure and temperature build-up beyond which arc-extinction could not be assured.

From the foregoing it should be clear that the size of the arc-extinguishing chamber 46, under low or no load current carrying conditions (See FIG. 2), should be sized so as to insure arc-interruption from the flow of gas through the nozzle throat. Similarly, the biasing means 32 should be sized such that, when a large load current is interrupted, the piston 30 will be free to move sufficiently far to the right to form an enlarged arc-extinguishing chamber 46' which will aid in arc-extinction under the self-extinguishing principle. It should be noted that the piston is allowed more travel to the right (FIG. 3) during high current interruption than would be evident from the travel associated with low current or the quiescent position (FIG. 1). In one design the size of the arc-extinguishing chamber 46 when the interrupter 10 is shut (FIG. 1) is approximately 40% to 45% of the maximum volume (FIG. 3).

Those skilled in the art know that interruption of an arc is achieved by transformation of the gas path between the open contacts, within an extremely short time after current zero, from a conductive plasma bridge to a high-grade insulator. Immediately after the current passes through zero the residual arc channel, which is still electrically conductive and which determines the thermal breaking limit begins to decay. On one hand, cooling brought about by the ablation of the insulating tip 22 and the nozzle 34 walls (as well as gas from volume 46) reduces the residual arc channel. On the other hand, the recovery voltage creates a post-arc current which tends to heat up the arc channel. The compressed spring 32, especially when large currents are interrupted, acts to shift the balance of competing thermodynamic factors in favor of keeping the arc from being re-established. It does this by forcing gas within the arcing chamber 46' and into the nozzle throat 44. Effectively, a post-interruption "gas boost" is provided to keep the arc from reforming.

From the foregoing, it should also be clear that numerous variations and modifications may be effected without departing from the spirit and scope of the novelty concept of the invention. For example, although cylindrical geometry has been used in describing the operation of the invention, other shapes and orientations may be used. It is equally true the arcing contacts 48 need not be in the form of a plurality of centrally disposed cluster of fingers or that the piston 30 be biased by a coil spring 32. Thus, it should be understood that no limitation with respect to the specific apparatus illustrated herein is intended or should be inferred. It is, of course, intended to cover by the appended claims, all modifications which fall within the scope of the claims that follow.

What is claimed is as follows:

1. A load interrupter, comprising:

(a) a generally cylindrical hollow casing having two ends, an interrupting end and an oppositely disposed vented end;

(b) a moving contact which is adapted to move relative to said casing and towards and away from the interior of said casing, said moving contact defining a free end and a fixed end, said free end being formed from an electrically insulating material with the remainder of said moving contact being formed from electrically conducting material;

(c) a piston which is sealingly disposed within said casing and which is free to move between said interrupting end and said vented end, said piston dividing the interior of said casing into two chambers, an interrupting chamber and a venting chamber;

(d) contacting means, carried by said piston, for electrically making contact with the free end of said moving contact and for transferring electrical current from said piston to said casing;

(e) biasing means, carried by one of said casing and said piston, for biasing said piston towards the interrupting end of said casing;

(f) flow control means, carried at the interrupting end of said casing, for directing the flow of fluid into and out of said interrupting chamber, said flow control means defining a throat formed from an electrically insulating material which is adapted to receive said free end of said moving contact, said moving contact when passed from the exterior of said casing and through said throat of said flow control means being of sufficient axial length so as to engage said contacting means and overcome said biasing means to position said piston intermediate said interrupting end and said vented end of said casing, the axial separation between said throat and the position of said piston when said piston is at the interrupting end of said housing being such that said contacting means is disengaged from said moving contact before the non-conducting tip of said moving contact is within said throat, whereby the electrical arc formed by separating said moving contact from said contact means is drawn between the exterior conducting portion of said moving contact and said throat such the flow of fluid out of said interrupting chamber is discharged around the periphery of said moving contact and in direct contact with said arc.

2. The load interrupter set forth in claim 1, wherein said casing and said moving contact are disposed within a tank filled with an arc-extinguishing gas.

3. The load interrupter set forth in claim 1, wherein said biasing means is a coil spring disposed between said piston and said vented end of said hollow casing.

4. The load interrupter set forth in claim 1, wherein said free end is formed from a silica loaded polytetrafluroethylene material or acetal.

5. The load interrupter set forth in claim 4, wherein that portion of said moving contact immediately adjacent to said silica loaded polytetrafluoroethylene is formed from an arc-resisting electrically conducting material.

6. The load interrupter set forth in claim 5, wherein said arc-resisting electrically conducting material is an alloy of copper and tungsten.

7. A self-extinguishing gas-blast load interrupter, comprising:

(a) a hollow cylindrical member adapted to be disposed within a space having an arc-extinguishing gas therein, said member having a first end and a second end, said second end having an opening therein;

(b) a cylindrical piston slidably disposed within said hollow cylindrical member for translational movement within said hollow cylindrical member between a first extreme position adjacent said first end and a second extreme position adjacent said second end, said second extreme position being at a pre-determined distance from said second end, said piston and said second end thereby defining a variable volume chamber within said hollow cylindrical member, said chamber being in gas communication with said space and accomodating a portion of said arc-extinguishing gas;

(c) stop means, disposed on the inside surface of said hollow cylindrical member, for stopping said piston at said pre-determined distance from said second end;

(d) means for biasing said piston against said stop means;

(e) a first contact member which carried by said piston and which is disposed towards said second end of said cylindrical member; and (f) a second contact member, having one end which is disposed towards the interior of said hollow cylindrical member and which is adapted for translational movement along the axis of said hollow cylindrical member between a first extreme position wherein said one end is disposed within said variable volume chamber and a second extreme position outside of said variable volume chamber, said second contact member when in its first extreme position through said opening and engaging said first contact member to form an electrical circuit therewith and overcoming said biasing means to move said piston to said first extreme position, said second contact member when it is in its second extreme position extending out of said hollow cylindrical member and clear of said opening in said second end of said hollow cylindrical member, said second contact member when moved from said first extreme position to said second extreme position forming an electrical arc across said first and second contact members when load current is flowing therethrough, said one end of said second contact member having a electrically insulated tip and an intermediate portion formed from an arc resisting electrically conducting material, said arc being drawn between said first contact member and said intermediate portion, whereby in the event that said arc is formed a portion of the arc-extinguishing gas in said chamber is heated and compressed by the movement of said piston towards said stop means, said heated and compressed gas being blown towards said opening and around said second contact member as said second contact member is withdrawn from said chamber.

8. The load interrupter set forth in claim 7, wherein said opening in said second end of said hollow cylindrical member is a LAVAL nozzle.

9. The load interrupter set forth in claim 7, wherein said opening in said second end of said hollow cylindrical member is formed in the shape of convergent-divergent nozzle whose throat is adapted to flow restrictively receive said second contact member; and wherein said first end of said hollow cylindrical member defines at least one opening for venting the space defined by said piston and the first end of said hollow cylindrical member.

10. The load interrupter set forth in claim 7, wherein said first end defines at least one opening for venting the space between said piston and said hollow cylindrical member at said first end.

11. The load interrupter set forth in claim 7, wherein said first contact member defines a plurality of radially spaced apart contact fingers having one end fixed to said piston and an opposite free end adapted to mate with said second contact member.

12. A load interrupter, comprising:

(a) a generally cylindrical hollow casing having one end which is closed and one end which is opened;

(b) a moving contact which is adapted to move relative to said casing and towards and away from the interior of said casing, said moving contact defining a free end and a fixed end, said free end being formed from non-conducting material with the remainder of said moving contact be formed from electrically conducting material;

(c) contacting means, carried by the closed end of said casing for electrically making contact with the free end of said moving contact and for transferring electrical current to said casing;

(d) flow control means, carried at the open end of said casing and electrically insulated therefrom, for directing the flow of fluid into and out of the interior of said casing, said flow control means defining a throat adapted to receive said free end of said moving contact, said moving contact when passed from the exterior of said casing and through said throat of said flow control means being of sufficient axial length so as to engage said contacting means, the axial separation between said throat and said contacting means being such that said contacting means is disengaged from said moving contact before the non-conducting tip of said moving contact enters said throat when said tip is moved out of said casing, whereby the electrical arc formed by separating said moving contact from said contact means with load current flowing therethrough is forced to enter the annulus defined by the exterior conducting portion of said moving contact and said throat and the flow of fluid out of said casing is discharged into said chamber.

13. The load interrupter set forth in claim 12, wherein said closed end of said casing is formed by a piston sealingly disposed within said casing so as to be free to move towards and away from said flow control means.

14. The load interrupter set form in claim 13, further including biasing means, disposed between said piston and said casing, for biasing said piston towards said flow control means.

* * * * *